United States Patent [19]

Chiu et al.

[11] 4,155,079

[45] May 15, 1979

[54] THEFT-PROOF SUITCASE

[75] Inventors: Tei-mo Chiu; Senug-Ming Chiu; Weally Sew, all of Taipei, Taiwan

[73] Assignee: Hui-Lang Shieh, Taipei, Taiwan

[21] Appl. No.: 738,127

[22] Filed: Nov. 2, 1976

[51] Int. Cl.[2] ..... G08B 13/14

[52] U.S. Cl. ..... 340/571; 340/686; 190/60

[58] Field of Search ..... 340/280, 283, 282, 220; 190/60, 42; 135/16

[56] References Cited

U.S. PATENT DOCUMENTS

| | | | |
|---|---|---|---|
| 702,403 | 6/1902 | Chapman | 190/42 |
| 919,385 | 4/1909 | Ruthven | 340/280 |
| 2,927,311 | 3/1960 | Donaldson | 340/283 |
| 3,144,065 | 8/1964 | Burgio, Jr. | 190/60 |
| 3,957,141 | 5/1976 | Domes | 190/60 |

*Primary Examiner*—Glen R. Swann, III

*Attorney, Agent, or Firm*—Burns, Doane, Swecker & Mathis

[57] ABSTRACT

Removal of a suitcase from the owner's hand causes a plug to be separated from a jack to supply power to an alarm circuit which provides audible and visible alarms. Alternatively, the alarm circuit is actuated by unauthorized movement of the suitcase from the position in which the user left it. For convenience, the suitcase includes a built in radio, an umbrella mounting and an external source of illumination.

4 Claims, 4 Drawing Figures

FIG 1
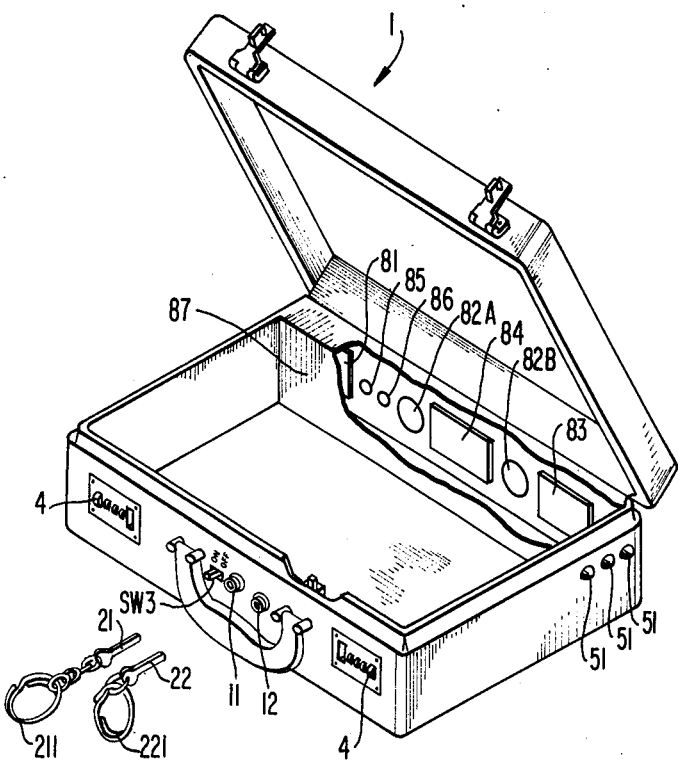
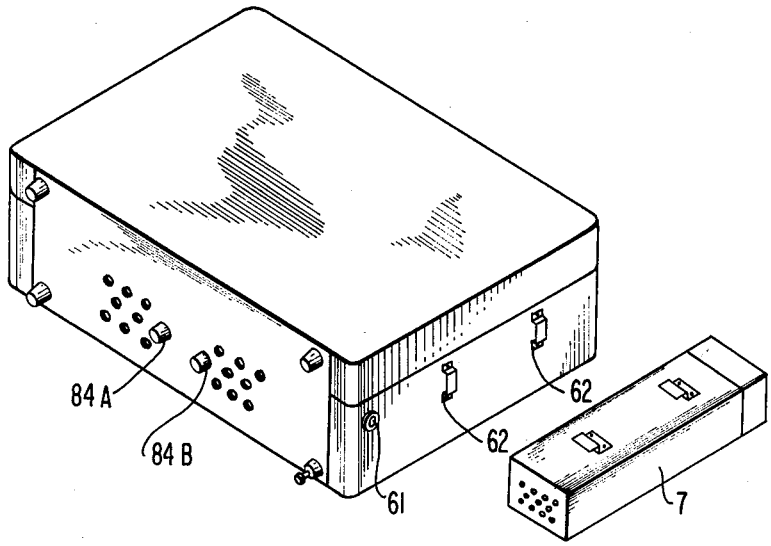
FIG 2

FIG 3
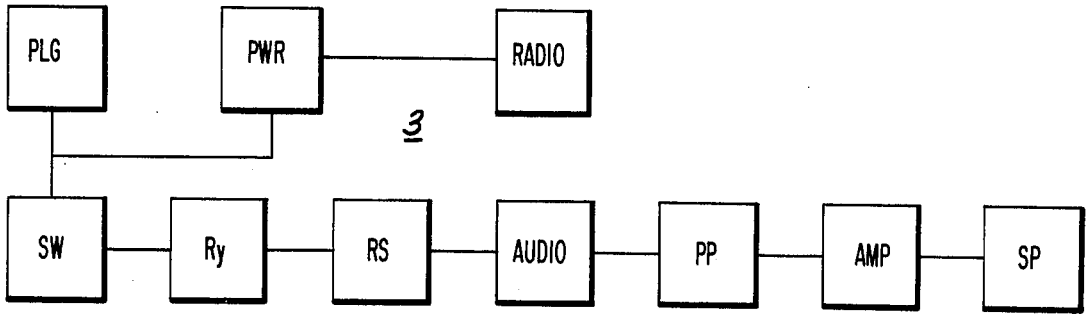
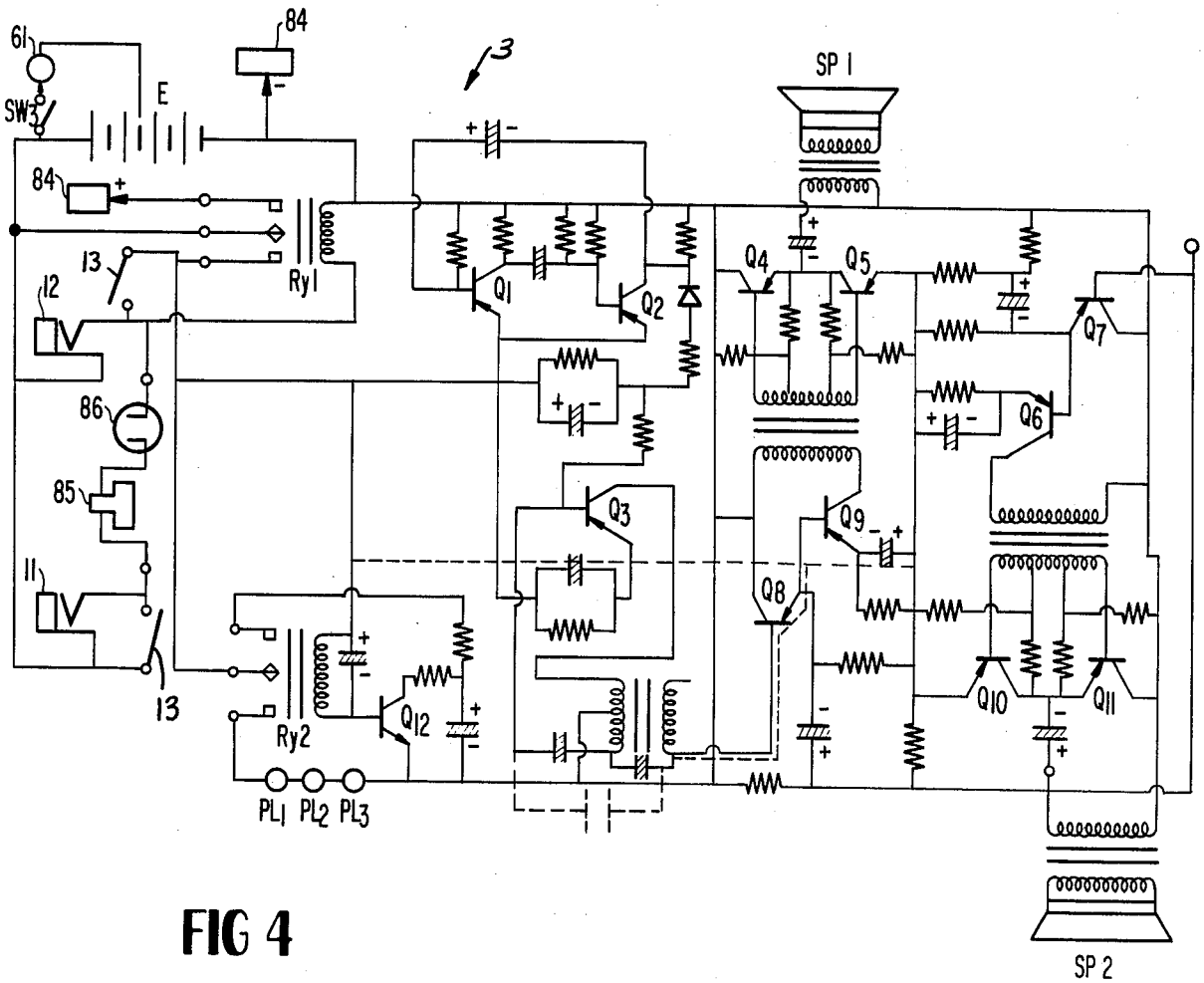
FIG 4

THEFT-PROOF SUITCASE

FIELD OF THE INVENTION

The present invention relates to a security suitcase having two alarm actuating devices to prevent it from being stolen and robbed respectively, and also having a radio set, an unbrella mounting means and a lighting means for enjoying music, mounting an umbrella and illumination, if desired.

BACKGROUND OF THE INVENTION

The traditional suitcase is nothing but a blank case in which clothes and other substances are placed. It is proper for carrying only, and is easily stolen or robbed. Moreover, the traditional suitcase has no attachments for other uses except carrying substances.

SUMMARY OF THE INVENTION

The main object of the present invention proposes a suitcase which is placed in security by a device set to avoid its being stolen. There is also included an alarm circuit. In any condition of robbery, the alarm circuit may immediately generate an alarm signal to ask for help.

A further object of the present invention proposes a radio set to hear news or enjoy music and an umbrella mounting means serving to mount an umbrella. All the other objects and features of the present invention will be mentioned in the following description taken in conjunction with the accompanying drawings.

BRIEF DESCRIPTION OF THE INVENTION

FIG. 1 depicts a perspective view of the safety suitcase according to the present invention.

FIG. 2 depicts a back view of the safety suitcase according to the present invention.

FIG. 3 depicts a block diagram of alarm circuit according to the present invention.

FIG. 4 depicts a circuit diagram of the alarm device of the safety suitcase according to the present invention.

DETAILED DESCRIPTION OF THE INVENTION

As shown in FIGS. 1 and 2, the perspective and back views of the safety suitcase according to the present invention, respectively, two jacks 11,12 are provided at the front side of a suitacase 1, and two specific plugs 21,22 having ring portions 211 and 221 respectively may be put in the said jacks 11,12 respectively to deactuate an alarm circuit 3 which is shown in FIG. 4. To prevent any other plugs from being in said two jacks 11,12 to deactuate the circuit, a built-in switch 13 is operated by numeral lock 4 of the suitcase 1 and is provided on the inner side of the suitcase 1.

Some pilot lamps 51—51 are placed on one side of the suitcase 1, these lamps 51—51 may be actuated by alarm circuit 3 for intermittent illumination. A lightling lamp 61, and a mounting means 62 are positioned on the other side of the suitcase 1 for illumination attaching an umbrella 7.

Power source 81, two speakers 82A, 82B, a printed circuit board 83 of the alarm circuit, a radio set 84, a standing switch 85 and a mercury switch 86 are sequentially arranged on the bottom side of the said suitcase 1 and shielded by an insulated plate 87. Tuning switch 84A and an ON/OFF switch 84B of radio set 84, and a standing switch 85, having a spring type switch 85A are all extended slightly to the outside of the bottom of the suitcase 1 as shown in FIG. 2.

In FIG. 3, the block diagram of the alarm circuit according to the present invention, the alarm circuit 3 is composed of ten portions, that is, plug PLG, power source PWR, radio set, switching portion SW, relays RY, multivibrator circuit RS, audio oscillator AUDIO push-pull circuit PP, amplifier AMP and speakers SP.

Power source PWR supplies power to the elements of the alarm circuit 3 and to the radio or lighting means which is mentioned above as the corresponding switches are turned on or actuated. Then the switching portion SW is operated by the plugs 21,22 and supplies power to the circuit.

Referring now to FIGS. 3 and 4, in the normal condition, when two plugs 21,22 are put in their respective jacks 11,12 respectively, the power source PWR will be cut-off to the alarm circuit. Therefore, there is no power distributed in the alarm circuit. When the plug 21 is pulled out from the jack 11, the jack 11 will be closed automatically and the suitcase anti-theft alarm is armed. When the suitcase 1 is put to the horizontal situation, the above-said standing switch 85 and mercury switch 86 are in "ON" and "OFF" condition respectively. When the suitcase is taken or moved by any person, the mercury switch 86 would turn to "ON" condition automatically, power source PWR is thus connected to the alarm circuit then to generate both acoustic and visible alarm signals. If the suitcase is left in a standing situation, the stand switch 85 is in "OFF" condition. In case the suitcase 1 is taken or moved, said standing switch 85 will be closed immediately to connect the power source PWR to the alarm circuit to generate an alarm signal also.

To prevent other plugs from being inserted in said jacks 11,12 to guard against robbers, the afore-said built-in switch 13 connects the power source PWR to the stand switch 85 and mercury switch 86. Thus, if there are any other plugs put in the jacks 11,12 of the suitcase 1, it would still generate the alarm signal when it is moved.

Provided the suitcase 1 is carried on one's hand, the ring portion 221 of the plug 22 should be put on his finger. If the suitcase 1 is robbed, the plug 22 would be pulled out from jack, 12, and jack 12 would be closed immediately to connect the power source PWR to the alarm circuit to generate an alarm.

The detailed circuit is shown in FIG. 4. When the plug 21 is inserted in the jack 11, power source PWR will be cut-off. When the suitcase 1 is closed, the built-in switch 13 is in "ON" condition to conduct the power to both standing switch 85 and mercury switch 86. However, when the suitcase 1 is put in a horizontal situation, the mercury switch 86 is turned off automatically. If the suitcase 1 was moved and the plug 21 was pulled out, both the stand switch 85 and mercury switch 86 will be turned on, and both the first relay RY 1 and second relay RY 2 are energized. Primarily, the power source PWR supplies power to the first relay Ry 1 at first, then to the two transistors Q1 and Q2 which are in multivibration. Therefore the transistors Q1 and Q2 which are in multivibtrator connection. Therefore the transistors Q1 and Q2 will generate a resonance signal to cause transistor Q3 to oscillate and generate an audio oscillation, and the audio signal is thus generated.

Afterwards, the audio signal will be amplified through the push-pull circuit which is composed of transistors Q4–Q7 and Q8–Q11 to actuate the two speakers SP1 and SP2 respectively. An acoustic alarm signal is generated intermittently from said speakers SP1 and SP2.

Secondarily, when the second relay RY 2 is energized, transistor Q12 will be actuated and the pilot lamps PL1, PL2 and PL3 will be lighted intermittently, that is, pilot lamps PL1, PL2 and PL3 twinkle one by one to form an alarm signal.

The illumination means 61 would be actuated when the switch SW3 is turned on.

The other elements of condensers and resisters are the corresponding accessories in the circuit to form the necessary bias or coupling circuit. As these parts are conventional disposition, the description is thus omitted.

It is understood that the present disclosure of the preferred embodiments of the invention has been made only by way of example and that numerous changes in details of construction and the combination of two or more of these embodiments may be resorted to without departing from the spirit and scope of the present invention as hereinafter claimed.

We claim:

1. A security suitcase, comprising:

an alarm circuit including a first relay circuit, a oscillation circuit connected to an energized via said relay circuit, an audio oscillator circuit driven by said oscillation circuit, a push-pull circuit connected to amplify the output of said audio oscillator circuit, and at least one speaker driven by said push-pull circuit;

a power source; and switching means for connecting said power source to said alarm circuit, said switching means including:

first and second jacks responsive to the presence of plugs therein to disconnect said power source from said alarm circuit;

a built-in switch located on the interior of said suitcase and accessible only by operation of a numerical lock, said switch operating to override the disconnecting function of said first and second jacks;

standing switch means responsive to the movement of said suitcase from an upright standing position to connect said power source to said alarm circuit; and mercury switch means responsive to movement of said suitcase from a horizontal position to connect said power source to said alarm circuit whereby removal of the plug from said first jack actuates said alarm circuit, and removal of the plug from said second jack arms the alarm circuit by connecting said power source to said standing switch and mercury switch such that the alarm circuit is actuated when the suitcase is not in a horizontal position unless said suitcase is standing in an upright position to thereby open said standing switch.

2. A security suitcase according to claim 1, wherein said alarm circuit further includes a second relay circuit, a transistor actuated by said second relay circuit and at least one signal lamp controlled by said transistor, and when the suitcase is moved or taken from its user, at least one of said first and second jacks, said standing switch means and said mercury switch means is closed to connect said power source to said second relay circuit to actuate said transistor to illuminate said at least one signal lamp intermittently.

3. The security suitcase according to claim 1, wherein said suitcase has a mounting means for mounting an umbrella, a radio set for receiving news or music if desired and a light means for illumination.

4. The suitcase according to claim 1, wherein said built-in switch is provided for conducting power to both said standing switch means and said mercury switch means to prevent the alarm circuit from being deactuated by putting unauthorized plugs in said jacks.

* * * * *